US011788799B2

(12) United States Patent
Matsumoto et al.

(10) Patent No.: US 11,788,799 B2
(45) Date of Patent: Oct. 17, 2023

(54) HEAT EXCHANGER AND AIR CONDITIONER

(71) Applicant: DAIKIN INDUSTRIES, LTD., Osaka (JP)

(72) Inventors: Yoshiyuki Matsumoto, Osaka (JP); Shun Yoshioka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 256 days.

(21) Appl. No.: 17/314,482

(22) Filed: May 7, 2021

(65) Prior Publication Data

US 2021/0262740 A1 Aug. 26, 2021

Related U.S. Application Data

(63) Continuation of application No. PCT/JP2019/042632, filed on Oct. 30, 2019.

(30) Foreign Application Priority Data

Nov. 7, 2018 (JP) ..... 2018-209800

(51) Int. Cl.
*F28F 9/02* (2006.01)
*F28F 1/32* (2006.01)
*F28F 1/02* (2006.01)

(52) U.S. Cl.
CPC . *F28F 1/32* (2013.01); *F28F 1/02* (2013.01)

(58) Field of Classification Search
CPC ..... F28F 1/32; F28F 1/02
(Continued)

(56) References Cited

U.S. PATENT DOCUMENTS

2006/0237178 A1* 10/2006 Katoh ..... F28F 3/04 165/170
2014/0116667 A1 5/2014 Choi et al.
(Continued)

FOREIGN PATENT DOCUMENTS

CN 105823364 A 8/2016
JP H05-090173 U 12/1993
(Continued)

OTHER PUBLICATIONS

Extended European Search Report issued in corresponding European Patent Application No. 19881402.2 dated Nov. 2, 2021 (7 pages).
(Continued)

*Primary Examiner* — Davis D Hwu
(74) *Attorney, Agent, or Firm* — Osha Bergman Watanabe & Burton LLP

(57) ABSTRACT

A heat exchanger includes: a flat tube having a width greater than a thickness of the flat tube; and fins fixed to the flat tube and that each include a plate-shaped fin body. The plate-shaped fin body of each of the fins faces the plate-shaped fin body of an adjacent one of the fins. Each of the fins has a tube receiving opening into which the flat tube is inserted. An edge of the tube receiving opening includes a first longitudinal side edge portion extending in a width direction of the flat tube. The tube receiving opening is in a notch shape that has: an open end on a first side of the first longitudinal side edge portion; and a closed end on a second side of the first longitudinal side edge portion.

8 Claims, 14 Drawing Sheets

(58) Field of Classification Search
USPC ..... 165/175
See application file for complete search history.

(56) References Cited

U.S. PATENT DOCUMENTS

| | | | |
|---|---|---|---|
| 2015/0075213 | A1 | 3/2015 | Ishibashi et al. |
| 2019/0137193 | A1 | 5/2019 | Yoshioka et al. |

FOREIGN PATENT DOCUMENTS

| | | | | |
|---|---|---|---|---|
| JP | H08166181 | A | * | 6/1996 |
| JP | 2735310 | B2 | * | 4/1998 |
| JP | 2005513403 | A | * | 5/2005 |
| JP | 2011-64403 | A | | 3/2011 |
| JP | 2011117628 | A | * | 6/2011 |
| JP | 2017-198440 | A | | 11/2017 |
| WO | 2010/049261 | A1 | | 5/2010 |
| WO | 2013/160951 | A1 | | 10/2013 |
| WO | 2017/183361 | A1 | | 10/2017 |
| WO | 2018/041138 | A1 | | 3/2018 |

OTHER PUBLICATIONS

International Preliminary Report on Patentability issued for International Patent Application No. PCT/JP2019/042632, dated May 11, 2021 (11 pages).
International Search Report issued in corresponding International Patent Application No. PCT/JP2019/042632 dated Dec. 10, 2019 (2 pages).

* cited by examiner

HEAT EXCHANGER AND AIR CONDITIONER

TECHNICAL FIELD

The present disclosure relates to a heat exchanger and an air conditioner.

BACKGROUND

Patent Document 1 discloses a heat exchanger including plate-shaped fins and flat tubes. The fins of the heat exchanger are provided with notches each having a shape corresponding to the flat tube, and heat transfer tubes are inserted into the notches of the fins.

Each of the fins of Patent Document 1 has a raised portion formed continuously from an edge of the notch to maintain an arrangement pitch of the fins. In the heat exchanger of Patent Document 1, the raised portion of each fin abuts on an adjacent one of the fins by a tip end portion thereof to maintain the arrangement pitch of the fins constant.

PATENT LITERATURE

Patent Document 1: Japanese Unexamined Patent Publication No. 2017-198440

SUMMARY

One or more embodiments of the present disclosure are directed to a heat exchanger including: a flat tube (20) having a width greater than its thickness; and a plurality of fins (30) fixed to the flat tube (20). Each of the plurality of fins (30) includes a plate-shaped fin body (31), the fin bodies (31) being arranged to face each other. Each of the plurality of fins (30) is provided with a tube receiving opening (33) into which the flat tube (20) is inserted. An edge of the tube receiving opening (33) of each fin (30) includes a longer side edge portion (34) extending in a width direction of the flat tube (20) inserted into the tube receiving opening (33). The tube receiving opening (33) of each fin (30) is formed in a notch shape, and has an open end (36) which is an end on one side of the longer side edge portion (34), and a closed end (37) which is another end on the other side of the longer side edge portion (34). Each of the fins (30) includes: a first protruding tab (40) protruding from the longer side edge portion (34) in a direction intersecting with the fin body (31) and having a tip end portion (41) that is located opposite to the longer side edge portion (34) in the direction intersecting with the fin body (31) and makes contact with the fin body (31) of an adjacent one of the fins (30); and a second protruding tab (50) protruding from the longer side edge portion (34) toward the same side as the first protruding tab (40), the second protruding tab (50) protruding less than the first protruding tab (40) in a direction orthogonal to the fin body (31). The second protruding tab (50) makes contact with the flat tube (20) inserted into the tube receiving opening (33). The first protruding tab (40) is shorter in length than the second protruding tab (50) in a direction along the longer side edge portion (34) of the fin (30).

DETAILED DESCRIPTION

An air conditioner (110) of one or more embodiments includes a refrigerant circuit (120) performing a refrigeration cycle, and conditions indoor air. The refrigerant circuit (120) of the air conditioner (110) is provided with a heat exchanger (10) of the present embodiments.

—Air Conditioner—

Figure 1:
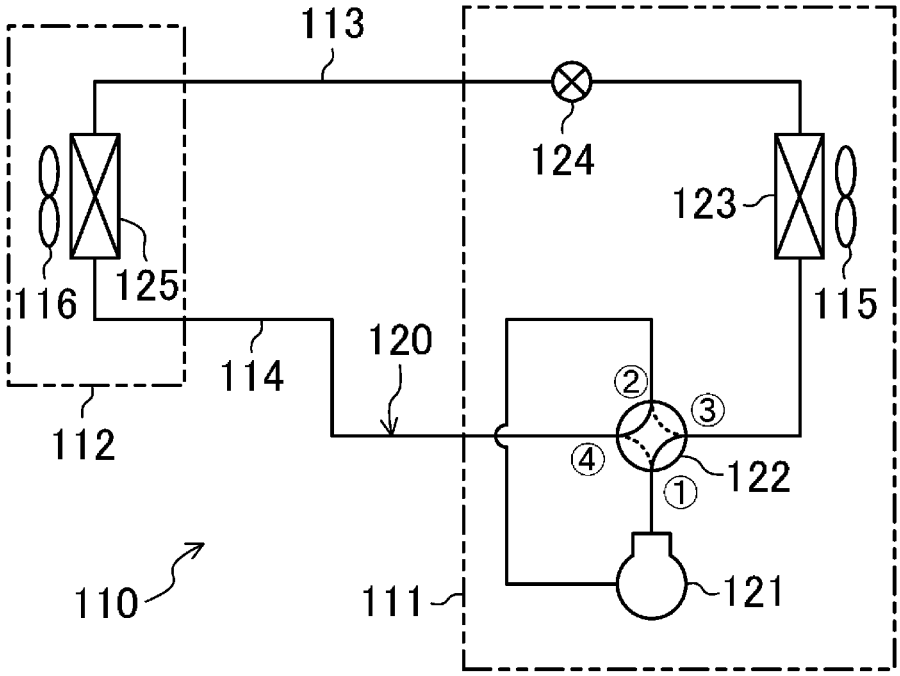
FIG. 1 is a piping system diagram showing a configuration of an air conditioner according to one or more embodiments.

The air conditioner (110) will be described with reference to FIG. 1.

<Configuration of Air Conditioner>

The air conditioner (110) includes an outdoor unit (111) and an indoor unit (112). The outdoor unit (111) and the indoor unit (112) are connected to each other via a liquid side connection pipe (113) and a gas side connection pipe (114). The outdoor unit (111), the indoor unit (112), the liquid side connection pipe (113), and the gas side connection pipe (114) form the refrigerant circuit (120) of the air conditioner (110).

The refrigerant circuit (120) includes a compressor (121), a four-way switching valve (122), an outdoor heat exchanger (123), an expansion valve (124), and an indoor heat exchanger (125). One or both of the outdoor heat exchanger (123) and the indoor heat exchanger (125) serve as a heat exchanger (10) of the present embodiments which will be described later.

The compressor (121), the four-way switching valve (122), the outdoor heat exchanger (123), and the expansion valve (124) are housed in the outdoor unit (111). The outdoor unit (111) is provided with an outdoor fan (115) for supplying outdoor air to the outdoor heat exchanger (123). The indoor heat exchanger (125) is housed in the indoor unit (112). The indoor unit (112) is provided with an indoor fan (116) for supplying indoor air to the indoor heat exchanger (125).

The refrigerant circuit (120) is a closed circuit filled with a refrigerant. The refrigerant filling the refrigerant circuit (120) may be a general fluorocarbon refrigerant such as HFC-32, or a general natural refrigerant such as carbon dioxide.

In the refrigerant circuit (120), the compressor (121) has a discharge pipe connected to a first port of the four-way switching valve (122), and a suction pipe connected to a second port of the four-way switching valve (122). The outdoor heat exchanger (123), the expansion valve (124), and the indoor heat exchanger (125) in the refrigerant circuit (120) are arranged in this order between a third port and fourth port of the four-way switching valve (122).

The compressor (121) is a scroll or rotary hermetic compressor. The four-way switching valve (122) switches between a first state in which the first port communicates with the third port and the second port communicates with the fourth port (indicated by solid curves FIG. 1), and a second state in which the first port communicates with the fourth port and the second port communicates with the third port (indicated by broken curves in FIG. 1). The expansion valve (124) is what is called an electronic expansion valve.

<Operation of Air Conditioner>

The air conditioner (110) selectively performs cooling operation and heating operation.

During the cooling operation, the refrigerant circuit (120) performs a refrigeration cycle with the four-way switching valve (122) set to the first state. In this state, the refrigerant circulates through the outdoor heat exchanger (123), the expansion valve (124), and the indoor heat exchanger (125) in this order, the outdoor heat exchanger (123) functions as a condenser, and the indoor heat exchanger (125) functions as an evaporator. In the outdoor heat exchanger (123), the refrigerant dissipates heat to the outdoor air to condense. In the indoor heat exchanger (125), the refrigerant absorbs heat from the indoor air to evaporate.

During the heating operation, the refrigerant circuit (120) performs a refrigeration cycle with the four-way switching valve (122) set to the second state. In this state, the refrigerant circulates through the indoor heat exchanger (125), the expansion valve (124), and the outdoor heat exchanger (123) in this order, the indoor heat exchanger (125) functions as a condenser, and the outdoor heat exchanger (123) functions as an evaporator. In the indoor heat exchanger (125), the refrigerant dissipates heat to the indoor air to condense. In the outdoor heat exchanger (123), the refrigerant absorbs heat from the outdoor air to evaporate.

—Configuration of Heat Exchanger—

Figure 2:
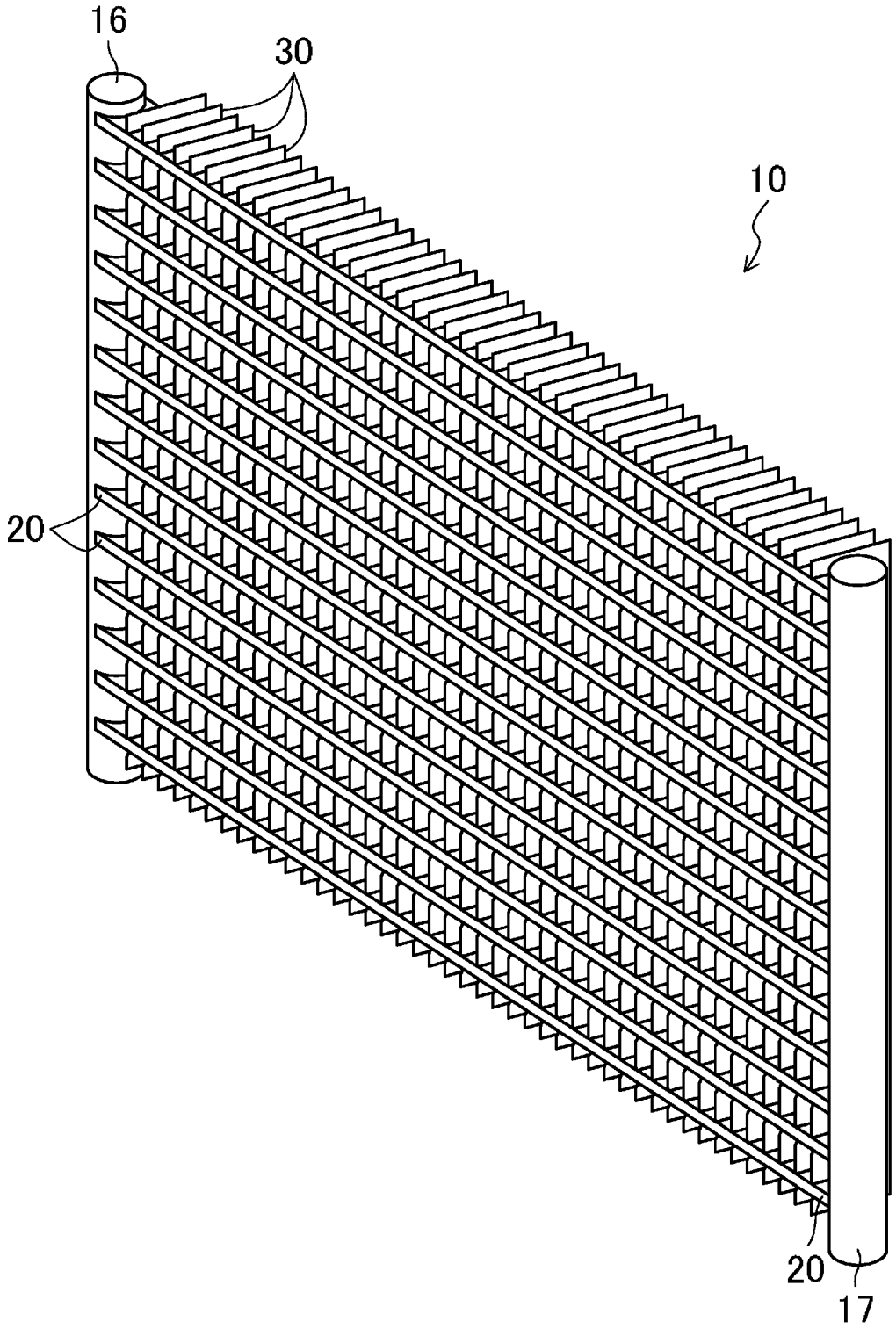
FIG. 2 is a schematic perspective view showing a heat exchanger according to the embodiments.
Figure 3:
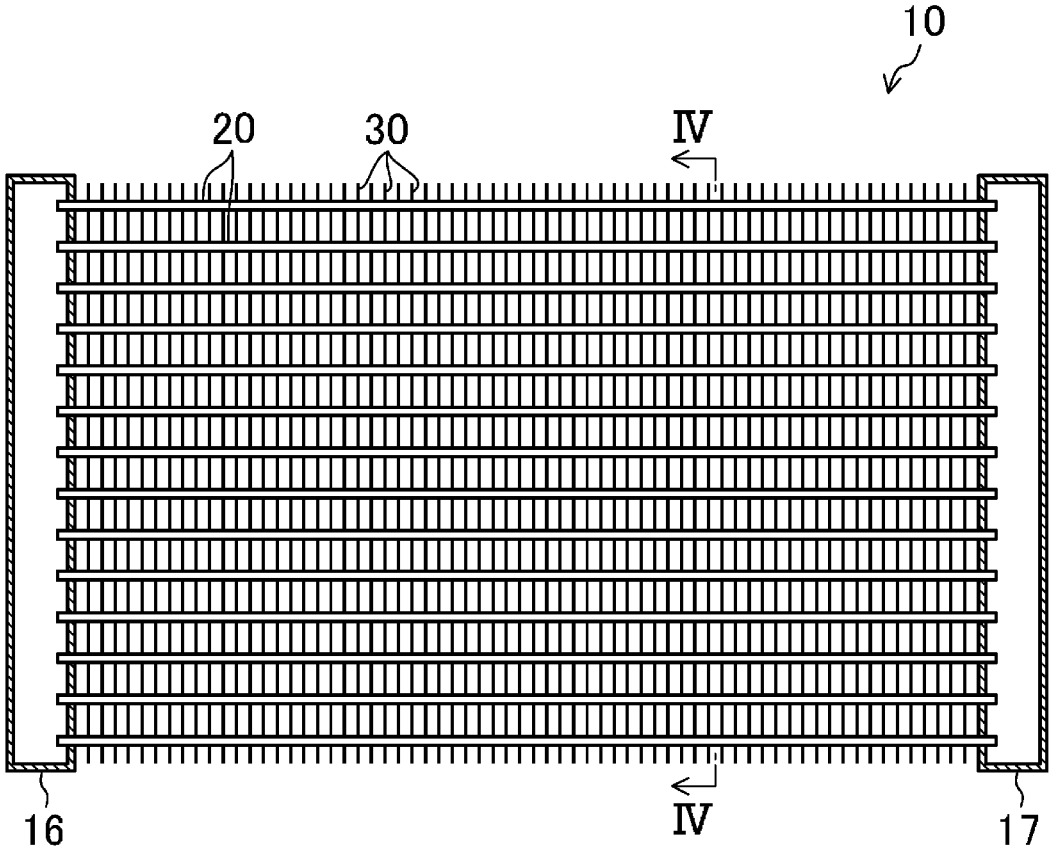
FIG. 3 is a partial cross-sectional view showing a front surface of the heat exchanger of the embodiments.

As shown in FIGS. 2 and 3, the heat exchanger (10) of the present embodiments includes a single first header collecting pipe (16), a single second header collecting pipe (17), multiple heat transfer tubes (20), and multiple fins (30). The first header collecting pipe (16), the second header collecting pipe (17), the heat transfer tubes (20), and the fins (30) are all made of an aluminum alloy.

<Header Collecting Pipe>

Each of the first header collecting pipe (16) and the second header collecting pipe (17) is formed in an elongated hollow cylindrical shape with both ends closed. In FIG. 3, the first header collecting pipe (16) and the second header collecting pipe (17), both in an upright state, are respectively arranged on the left and right ends of the heat exchanger (10).

<Heat Transfer Tube>

Figure 4:
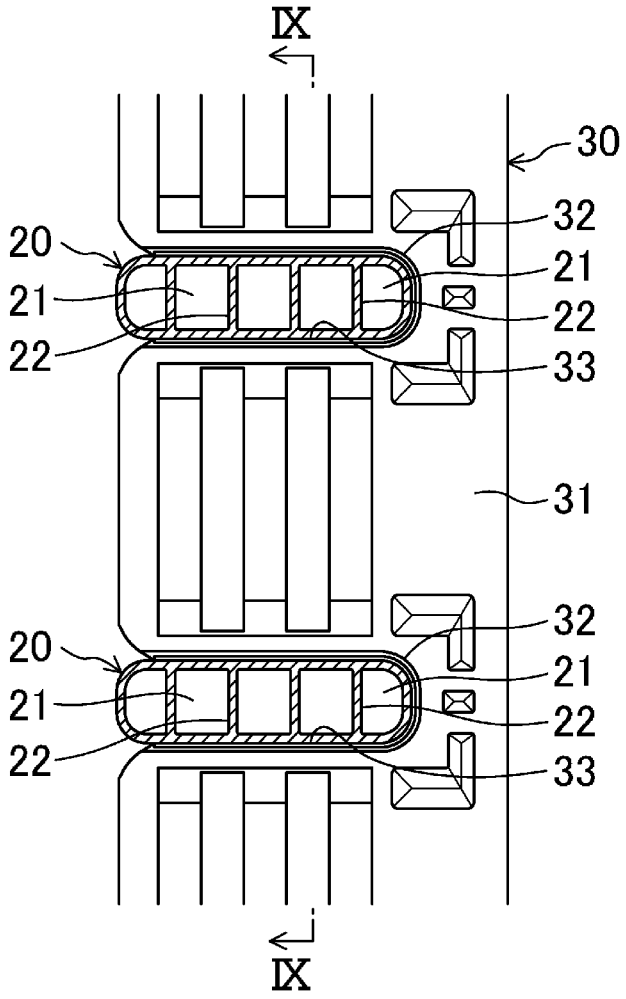
FIG. 4 is an enlarged cross-sectional view of the heat exchanger taken along line IV-IV of FIG. 3.

As shown in FIG. 4, each of the heat transfer tubes (20) has a rectangular cross section with rounded corners, the cross section being orthogonal to the direction in which the heat transfer tube (20) extends from one end to the other end. The heat transfer tube (20) is a flat tube having a width greater than its thickness. The thickness of the heat transfer tube (20) is a length in the vertical direction in FIG. 4, and the width of the heat transfer tube (20) is a dimension in the right-to-left direction in FIG. 4. The heat transfer tubes (20) are arranged such that their direction of extension substantially coincides with the horizontal direction, and side surfaces thereof extending along the width direction face each other. The heat transfer tubes (20) are vertically arranged at regular intervals.

One end of the heat transfer tube (20) is inserted into the first header collecting pipe (16), and the other end thereof into the second header collecting pipe (17). As will be described in detail later, the header collecting pipes (16, 17) are fixed to the heat transfer tubes (20) by brazing using a brazing material (15).

A plurality of flow passages (21) partitioned by partition walls (22) are formed in each heat transfer tube (20). The heat transfer tube (20) of the present embodiments has four partition walls (22) and five flow passages (21). Note that the numbers of the partition walls (22) and the flow passages (21) are merely examples. In the heat transfer tube (20), the five flow passages (21) extend in parallel with each other along the extending direction of the heat transfer tube (20), and open at both ends of the heat transfer tube (20). The five flow passages (21) in the heat transfer tube (20) are arranged in a row in the width direction of the heat transfer tube (20).

<Fin>

Figure 5:
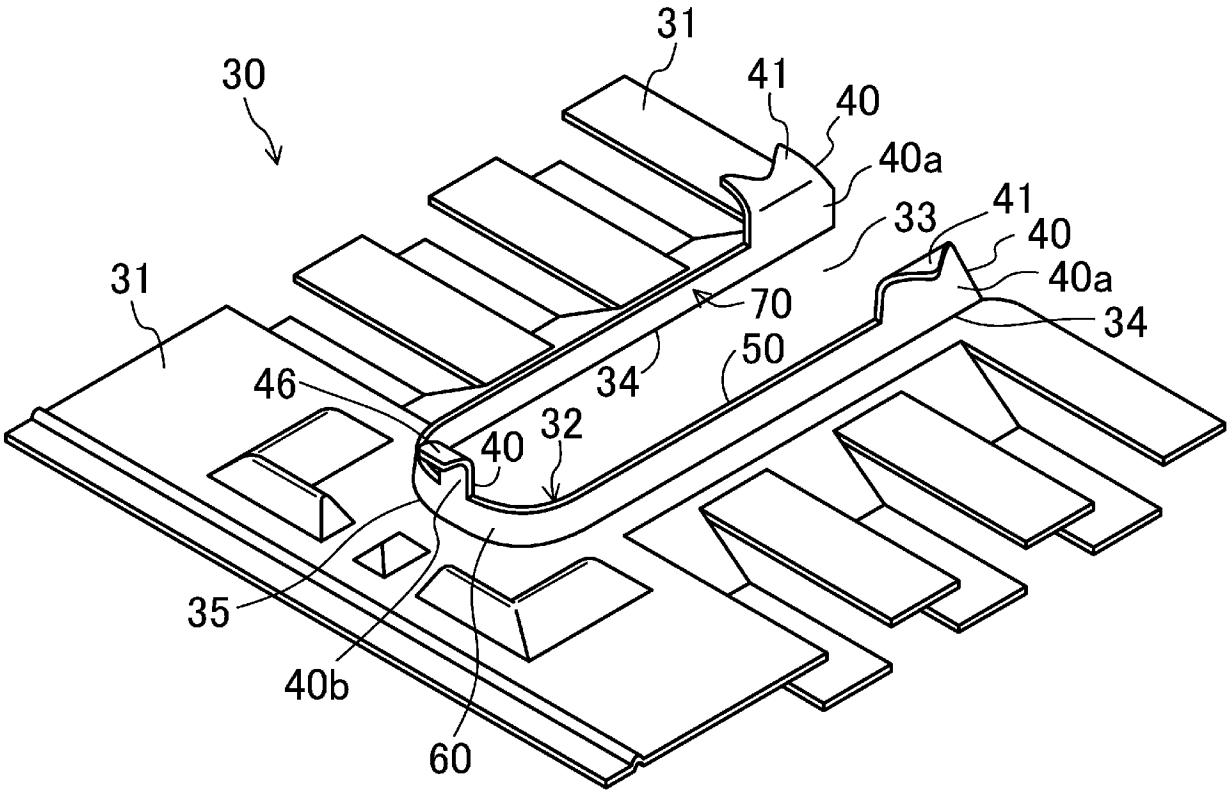
FIG. 5 is a perspective view showing a major part of a fin according to the embodiments.

As shown in FIGS. 4 and 5, the fin (30) includes a fin body (31) formed in a generally rectangular plate shape, and collars (32) formed integrally with the fin body (31). The fin body (31) has a plurality of tube receiving openings (33) into which the heat transfer tubes (20) are inserted. The fins (30) are formed through pressing of a flat plate-shaped material.

Figure 6:
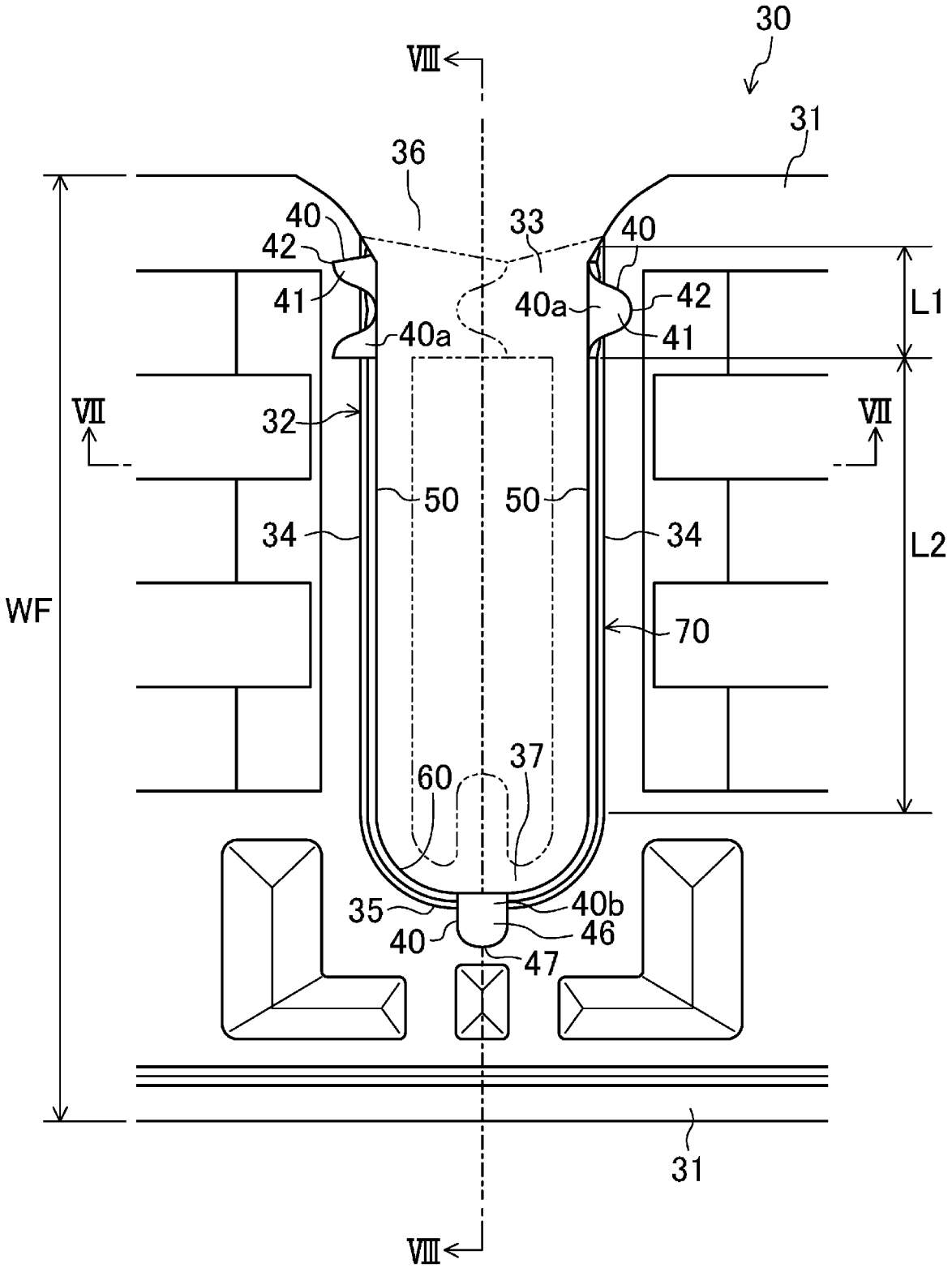
FIG. 6 is a plan view showing a major part of the fin according to the embodiments.

As also shown in FIG. 6, the tube receiving opening (33) is cut in the shape of a notch that opens in one of long sides of the fin body (31) and extends in a short side direction (width direction) of the fin body (31). The long sides of the fin body (31) extend in the right-to-left direction in FIG. 6, and the short side direction of the fin body (31) is the vertical direction in FIG. 6.

Figure 8:
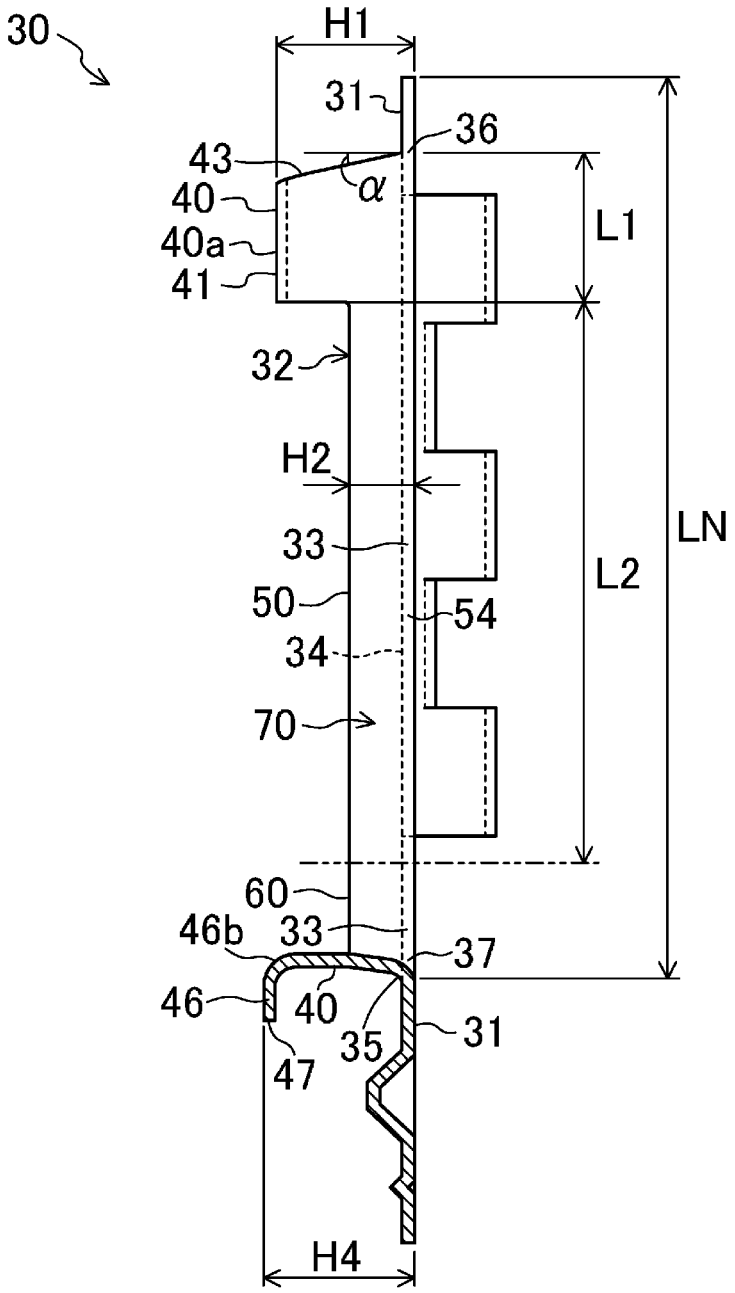
FIG. 8 is a cross-sectional view of the fin taken along line VIII-VIII of FIG. 6.

As shown in FIGS. 6 and 8, the tube receiving opening (33) has an elongated shape corresponding to the shape of the heat transfer tube (20) which is a flat tube. A length LN of the tube receiving opening (33) in the short side direction of the fin body (31) is greater than half the width WF of the fin body (31) (LN>WF/2).

The tube receiving opening (33) has an open end (36) which is an end that opens at one of the long sides of the fin body (31), and a closed end (37) which is the other end opposite to the open end in the short side direction (width direction) of the fin body (31). The tube receiving openings (33) are formed in the fin body (31) at regular intervals in the long side direction of the fin body (31).

The collar (32) is formed continuously from an edge of each of the tube receiving openings (33) of the fin body (31). The collar (32) protrudes from the edge of the tube receiving opening (33) in a direction intersecting with the fin body (31). The collar (32) will be described in detail later.

The fins (30) are arranged so that their fin bodies (31) face each other. The fins (30) are arranged so that their tube receiving openings (33) are arranged in a row. As will be described in detail later, an interval between the fin bodies (31) of each adjacent pair of the fins (30) is kept constant when open end-side protruding tabs (40*a*) and closed end-side protruding tab (40*b*) of the collar (32) of one of the fins (30) come into contact with the fin body (31) of the other fin (30).

As will be described in detail later, an inner surface of the collar (32) of the fin (30) makes contact with an outer surface of the heat transfer tube (20). The collar (32) of the fin (30) is fixed to the heat transfer tube (20) by brazing using the brazing material (15).

—Collar of Fin—

The collar (32) of the fin (30) will be described in detail with reference to FIGS. 5 to 8 as appropriate.

As shown in FIG. 5, the collar (32) is formed continuously from the edge of each tube receiving opening (33) of the fin body (31). An aluminum alloy plate, which is a flat plate-shaped material, is cut and bent up to form the collar (32) integrally with the fin body (31).

The collar (32) is a portion protruding from the edge of each tube receiving opening (33) in a direction intersecting with the fin body (31). Each collar (32) includes a pair of open end-side protruding tabs (40*a*), a single tube joint portion (70), and a single closed end-side protruding tab (40*b*). The open end-side protruding tabs (40*a*), the tube joint portion (70), and the closed end-side protruding tab (40*b*) protrude toward the same side with respect to the fin body (31). As will be described in detail later, the open end-side protruding tabs (40*a*) and the closed end-side protruding tab (40*b*) serve as first protruding tabs (40) for maintaining the interval from the adjacent fin body (31).

As shown in FIG. 6, the edge of the tube receiving opening (33) of the fin body (31) includes a pair of longer side edge portions (34, i.e., longitudinal side edge portions) and a shorter side edge portion (35, i.e., short side edge portion).

Each of the longer side edge portions (34) is a portion of the edge of the tube receiving opening (33) extending linearly along the short side direction of the fin body (31). Linear portions of the edge of the tube receiving opening (33) extending in the short side direction of the fin body (31) entirely serve as the longer side edge portions (34). The longer side edge portions (34) extend in the width direction of the heat transfer tube (20) inserted into the tube receiving opening (33), and are parallel to each other.

The shorter side edge portion (35) is a portion of the edge of the tube receiving opening (33) facing the closed end (37) of the tube receiving opening (33). The shorter side edge portion (35) is formed in a U-shape when viewed from a direction perpendicular to the fin body (31), and connects ends of the longer side edge portions (34) near the closed end (37) of the tube receiving opening (33).

<Open End-Side Protruding Tab>

The open end-side protruding tabs (40*a*) are plate-shaped portions each rising from the longer side edge portion (34). Each of the open end-side protruding tabs (40*a*) is formed continuously from a portion of the longer side edge portion (34) including the open end (36) of the tube receiving opening (33). That is, the open end-side protruding tabs (40*a*) are arranged near the open end (36) of the tube receiving opening (33).

The pair of open end-side protruding tabs (40*a*) provided for the collar (32) face each other across the tube receiving opening (33). The open end-side protruding tabs (40*a*) have a length L1 in the direction along the longer side edge portion (34) (see FIGS. 6 and 8).

Figure 7:
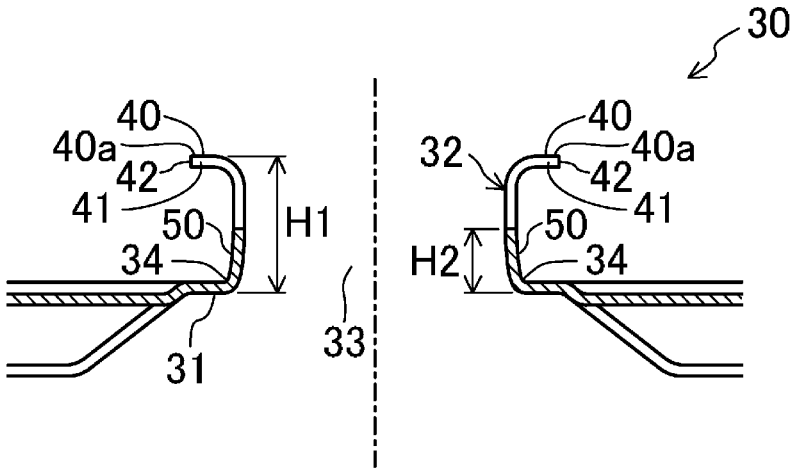
FIG. 7 is a cross-sectional view of the fin taken along line VII-VII of FIG. 6.

As shown in FIG. 7, a tip end portion (41) of each open end-side protruding tab (40*a*) is bent outward of the tube receiving opening (33). The tip end portion (41) of the open end-side protruding tab (40*a*) is a portion including a tip end (42) of the open end-side protruding tab (40*a*) and a region around the tip end (42).

The open end-side protruding tabs (40*a*) have a height H1 in the direction intersecting with the fin body (31) (i.e., a direction in which the open end-side protruding tabs (40*a*) protrude) (see FIG. 8). The height H1 of the open end-side protruding tabs (40*a*) is the distance from a back surface of the fin body (31) (i.e., a surface opposite to the surface from which the open end-side protruding tabs (40*a*) protrude) to the front surface of the tip end portion (41) of the open end-side protruding tab (40*a*) (i.e., the surface facing away from the fin body (31)).

The tip end (42) of the open end-side protruding tab (40*a*) has a wavy shape meandering in the extending direction (i.e., a direction from a base end to tip end (42)) of the open end-side protruding tab (40*a*). The tip end portions (41) of the pair of open end-side protruding tabs (40*a*) provided for the collar (32) have complementary shapes (see the phantom lines in FIG. 6).

A side portion (43, or an edge) of each open end-side protruding tab (40*a*) close to (i.e., adjacent to) the open end (36) of the tube receiving opening (33) is tilted toward the closed end (37) of the tube receiving opening (33). Specifically, the side portion (43) is tilted toward the closed end (37) of the tube receiving opening (33) as it extends from a base end to tip end (42) of the open end-side protruding tab (40). In one or more embodiments, the side portion (43) has an inclination angle $\alpha$ which is greater than or equal to 10° ($\alpha \geq 10°$). The inclination angle $\alpha$ of the side portion (43) is an angle of the side portion (43) with respect to a line perpendicular to the fin body (31).

<Tube Joint Portion, Longer Side Joint Portion, and Closed End-Side Joint Portion>

As shown in FIGS. 5 and 6, the tube joint portion (70) is a portion of the edge of the tube receiving opening (33) other than the portion where the open end-side protruding tabs (40*a*) are formed. Specifically, the tube joint portion (70) includes the two longer side edge portions (34) and the single shorter side edge portion (35). The tube joint portion (70) is a plate-shaped portion rising from the longer side edge portions (34) and the shorter side edge portion (35), and is formed as a wall in the shape of U in plan view. The tube joint portion (70) is formed integrally with the open end-side protruding tabs (40*a*).

As shown in FIG. 8, the tube joint portion (70) has a height H2 in the direction intersecting with the fin body (i.e., a direction in which the tube joint portion (70) protrudes), which is constant over the entire length of the tube joint portion (70). The height H2 of the tube joint portion (70) is a distance from the back surface of the fin body (31) to the tip end of the tube joint portion (70). The height H2 of the tube joint portion (70) is smaller than the height H1 of the open end-side protruding tabs (40*a*) (H2<H1). In other words, the tube joint portion (70) protrudes less than the open end-side protruding tabs (40*a*) in a direction orthogonal to the fin body (31).

The tube joint portion (70) includes the pair of longer side joint portions (50, i.e., longitudinal side joint portions) and the closed end-side joint portion (60). The longer side joint portions (50) are portions of the tube joint portion (70) rising from the longer side edge portions (34). Tip ends of the longer side joint portions (50) extend linearly to be substantially parallel to the longer side edge portions (34). The longer side joint portion (50) extending along one of the longer side edge portions (34) and the longer side joint portion (50) extending along the other longer side edge portion (34) face each other across the tube receiving opening (33). The closed end-side joint portion (60) is a portion of the tube joint portion (70) rising from the shorter side edge portion (35). The closed end-side joint portion (60) is formed in a plate shape curved in a C shape along the shorter side edge portion (35).

As shown in FIGS. 6 and 8, a length L2 of the longer side joint portions (50) is greater than a length L1 of the open end-side protruding tabs (40*a*) in a direction along the longer side edge portions (34) (L2>L1). In the present embodiments, the length L2 of the longer side joint portions (50) is about four to five times as long as the length L1 of the open end-side protruding tabs (40*a*). In one or more embodiments, the length L2 of the longer side joint portions (50) is equal to or greater than half the width WT of the heat transfer tube (20) to be inserted into the tube receiving opening (33) (L2≥WT/2).

As described above, the longer side joint portions (50) of the present embodiments are relatively simple-shaped portions each having a linearly extending tip end. Therefore, in the present embodiments, the longer side joint portions (50) can be easily formed.

<Closed End-Side Protruding Tab>

The closed end-side protruding tab (40*b*) is formed integrally with the closed end-side joint portion (60). The closed end-side protruding tab (40*b*) is arranged at a portion of the closed end-side joint portion (60) farthest from the open end (36) of the tube receiving opening (33) (that is, the lowermost portion in FIGS. 6 and 8). The closed end-side protruding tab (40*b*) is a plate-shaped portion extending from the tip end of the closed end-side joint portion (60) in the same direction as the closed end-side joint portion (60). A tip end portion (46) of the closed end-side protruding tab (40*b*) is bent outward (that is, downward in FIGS. 6 and 8) of the tube receiving opening (33). The tip end portion (46) of the closed end-side protruding tab (40*b*) is a portion including a tip end (47) of the closed end-side protruding tab (40*b*) and a region around the tip end (47).

The closed end-side protruding tab (40*b*) has a height H4 in the direction intersecting with the fin body (31) (i.e., a direction in which the closed end-side protruding tab (40*b*) protrudes) (see FIG. 8). The height H4 of the closed end-side protruding tab (40*b*) is the distance from a back surface of the fin body (31) (i.e., a surface opposite to the surface from which the closed end-side protruding tab (40*b*) protrudes) to the front surface of the tip end portion (46) of the closed end-side protruding tab (40*b*) (i.e., the surface facing away from the fin body (31)). The height H4 of the closed end-side protruding tab (40*b*) is equal to the height H1 of the open end-side protruding tabs (40*a*) (H4=H1). In other words, the closed end-side protruding tab (40*b*) protrudes to the same degree as the open end-side protruding tabs (40*a*) in the direction orthogonal to the fin body (31).

(Step of Forming Collar)

As described above, the collar (32) is formed through several steps of pressing an aluminum alloy plate, which is a flat plate-shaped material.

In the first pressing step, the plate as the material is cut as indicated by a phantom line in FIG. 6. In the second pressing step, the plate cut in the first pressing is bent in a direction intersecting with a main surface of the plate. The tube joint portion (70) is completed in the second pressing step. In the subsequent third pressing step, the tip end portions (41) of the open end-side protruding tabs (40*a*) and the tip end portion (46) of the closed end-side protruding tab (40*b*) are bent. The collar (32) is formed through the three pressing steps.

—Joint Between Fins and Heat Transfer Tubes—

As described above, the fins (30) are arranged such that the fin bodies (31) face each other and the tube receiving openings (33) are arranged in a row. Then, the heat transfer tubes (20) are inserted into the tube receiving openings (33) of the arranged fins (30).

Figure 9:
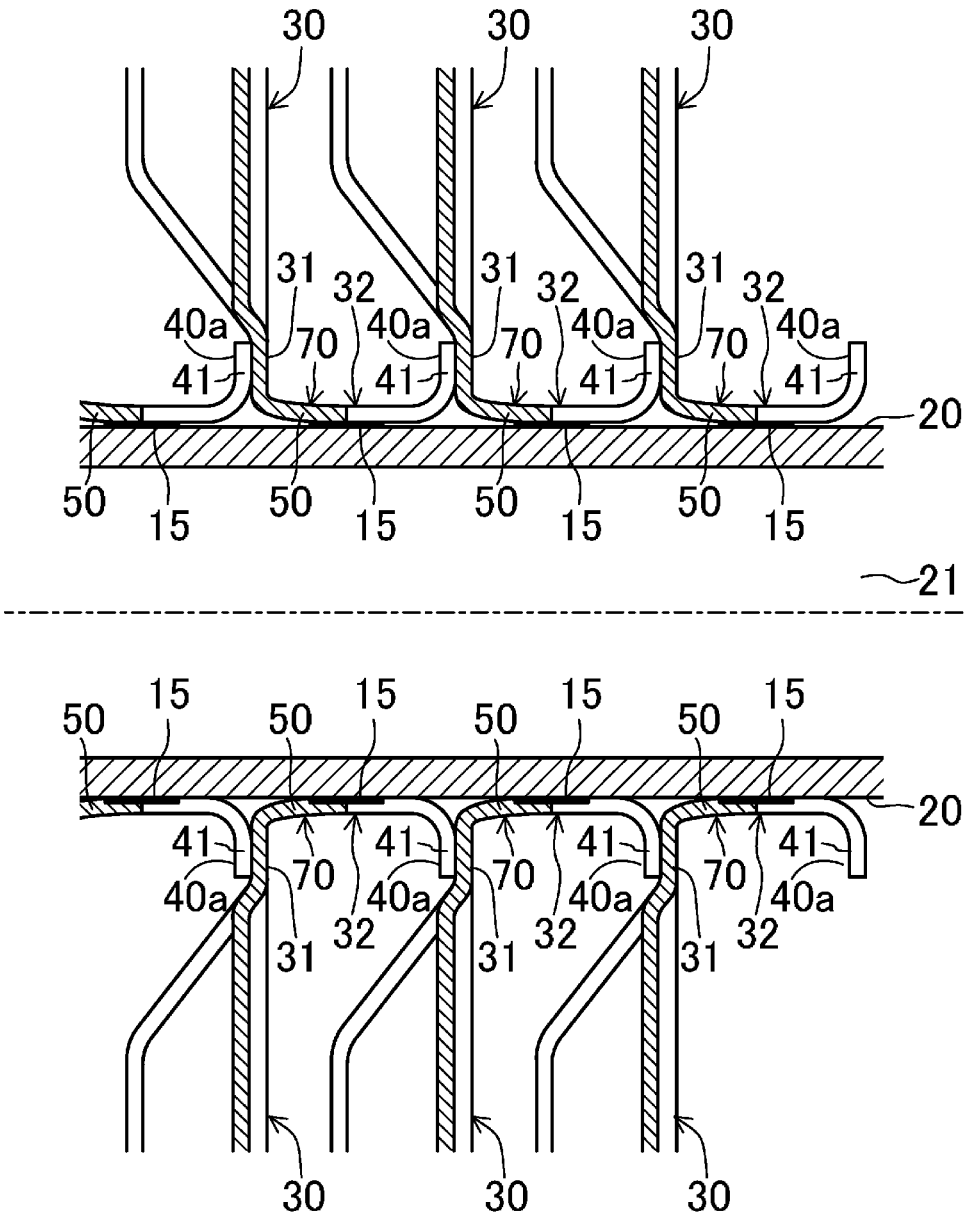
FIG. 9 is an enlarged cross-sectional view of the heat exchanger taken along line IX-IX of FIG. 4.

As shown in FIG. 9, the tip end portions (41) of the open end-side protruding tabs (40*a*) and the tip end portion (46) of the closed end-side protruding tab (40*b*) of each of the fins (30) abut on the back surface of the fin body (31) of an adjacent one of the fins (30). Since the open end-side protruding tabs (40*a*) and the closed end-side protruding tab (40*b*) of each fin (30) abut on the fin body (31) of the adjacent fin (30), the interval between the fin bodies (31) of the adjacent fins (30) is kept constant.

As described above, the height H2 of the tube joint portion (70) is smaller than the height H1 of the open end-side protruding tabs (40*a*) and the height H4 of the closed end-side protruding tab (40*b*). Therefore, with the open end-side protruding tabs (40*a*) and the closed end-side protruding tab (40*b*) of the fin (30) abutting on the adjacent fin (30), the longer side joint portions (50) and the closed end-side joint portion (60) constituting the tube joint portion (70) are noncontact with the adjacent fin (30). The longer side joint portions (50) and the closed end-side joint portion (60) constituting the tube joint portion (70) make contact with the outer surface of the heat transfer tube (20).

In the heat exchanger (10) of the present embodiments, the fins (30) are brazed to the heat transfer tubes (20). As shown in FIG. 9, the tube joint portion (70) including the longer side joint portions (50) of each fin (30) is joined to the heat transfer tube (20) by the brazing material (15) which is a joining material. The base ends of the open end-side protruding tabs (40*a*) of each fin (30) are also joined to the heat transfer tube (20) by the brazing material (15) serving as the joining material.

—Feature (1) of Embodiments—

The heat exchanger (10) of these embodiments includes the flat tubes (20) each having a width greater than its thickness, and a plurality of fins (30) fixed to the flat tubes (20). Each of the fins (30) has the plate-shaped fin body (31), and the fin bodies (31) are arranged to face each other. Each of the fins (30) is provided with the tube receiving openings (33) into which the flat tubes (20) are inserted. The edge of each tube receiving opening (33) of the fin (30) includes the longer side edge portions (34) extending in the width direction of the flat tube (20) inserted into the tube receiving opening (33). The tube receiving opening (33) of the fin (30) is formed in a notch shape, and has the open end (36) which is an end on one side of the longer side edge portions (34), and the closed end (37) which is another end on the other side of the longer side edge portions (34). Each of the fins (30) is provided with the open end-side protruding tabs (40*a*) and the longer side joint portions (50). Each of the open end-side protruding tabs (40*a*) protrudes from an associated one of the longer side edge portions (34) in the direction intersecting with the fin body (31), and has the tip end portion (41) that is located opposite to the longer side edge portion (34) in the direction intersecting with the fin body (31) and makes contact with the fin body (31) of the adjacent fin (30). The longer side joint portions (50) protrude from the longer side edge portions (34) to the same side as the open end-side protruding tabs (40*a*), and are shorter in height than the open end-side protruding tabs (40*a*) in the direction intersecting with the fin body (31). The longer side joint portions (50) make contact with the flat tube (20) inserted into the tube receiving opening (33). The open end-side protruding tabs (40*a*) are shorter than the longer side joint portions (50) in a direction along the longer side edge portions (34) of the fin (30).

In the heat exchanger (10) of the present embodiments, each of the plurality of fins (30) is provided with the open end-side protruding tabs (40*a*) and the longer side joint portions (50). In this heat exchanger (10), the tip end portions (41) of the open end-side protruding tabs (40*a*) of each fin (30) make contact with the fin body (31) of an adjacent one of the fins (30), which keeps the interval between the fin bodies (31) of the fins (30). The longer side joint portions (50) have a smaller height than the open end-side protruding tabs (40*a*). Therefore, the tip end portions of the longer side joint portions (50) are noncontact with the fin body (31) of the adjacent fin (30).

In the fin (30) of the present embodiments, the open end-side protruding tabs (40*a*) is shorter in length than the longer side joint portions (50) in the direction along the longer side edge portions (34) of the fin (30). Thus, a region where the open end-side protruding tabs (40*a*) make contact with the fin body (31) of the adjacent fin (30) is smaller than that in the case in which the protruding tabs for keeping the interval between the fin bodies extend over the entire length of the longer side edge portions (34). Therefore, according to the present embodiments, the amount of condensed water collected in the gap between the open end-side protruding tabs (40*a*) and the adjacent fin body (31) can be reduced.

—Feature (2) of Embodiments—

In the heat exchanger (10) of the present embodiments, the open end-side protruding tabs (40*a*) are arranged closer to the open end (36) of the tube receiving opening (33) than the longer side joint portions (50).

A portion of the fin body (31) located between an adjacent pair of tube receiving openings (33) is more likely to be deformed at a position closer to the open ends (36) of the tube receiving openings (33). On the other hand, in the heat exchanger (10) of the present embodiments, the open end-side protruding tabs (40*a*) are arranged closer to the open end (36) of the tube receiving opening (33) than the longer side joint portions (50). Therefore, according to the present embodiments, deformation of the portion of the fin body (31) located between the adjacent tube receiving openings (33) can be reduced, and as a result, the interval between the fin bodies (31) can be maintained.

—Feature (3) of Embodiments—

In the heat exchanger (10) of the present embodiments, the open end-side protruding tab (40*a*) and the longer side joint portion (50) are provided for each of the pair of longer side edge portions (34) facing each other across the flat tube (20) inserted into the tube receiving opening (33).

In the heat exchanger (10) of the present embodiments, the pair of longer side edge portions (34) facing each other across the heat transfer tube (20) inserted into the tube receiving opening (33) are present at the edge of each of the tube receiving openings (33) of the fins (30). In the heat exchanger (10) of the present embodiments, the open end-side protruding tab (40*a*) and the longer side joint portion (50) are provided for each of the pair of longer side edge portions (34).

In the heat exchanger (10) of the present embodiments, the open end-side protruding tabs (40*a*) are provided on both sides of each of the heat transfer tubes (20), and the open end-side protruding tabs (40*a*) make contact with the fin body (31) of the adjacent fin (30). Therefore, according to the present embodiments, the interval between the adjacent fin bodies (31) can be maintained.

—Feature (4) of Embodiments—

In the heat exchanger (10) of the present embodiments, the open end-side protruding tabs (40*a*) respectively provided for the pair of longer side edge portions (34) of the tube receiving opening (33) face each other, and the longer side joint portions (50) respectively provided for the pair of longer side edge portions (34) of the tube receiving opening (33) face each other.

In the heat exchanger (10) of the present embodiments, the open end-side protruding tabs (40*a*) respectively provided for the longer side edge portions (34) face each other, and the longer side joint portions (50) respectively provided for the longer side edge portions (34) face each other.

—Feature (5) of Embodiments—

In the heat exchanger (10) of the present embodiments, the edge of the tube receiving opening (33) of the fin (30) includes the shorter side edge portion (35), which is a portion facing the closed end (37) of the tube receiving opening (33). The open end-side protruding tabs (40*a*) are provided for the longer side edge portions (34), and the closed end-side protruding tab (40*b*) is provided for the shorter side edge portion (35).

In the heat exchanger (10) of the present embodiments, the open end-side protruding tabs (40*a*) are provided for the longer side edge portions (34) of the fin (30), and the closed end-side protruding tab (40*b*) is provided for the shorter side edge portion (35). Thus, the protruding tabs (40*a*, 40*b*) for maintaining the interval between the fin bodies (31) are provided at at least two positions in the width direction of the heat transfer tube (20). Therefore, according to the present embodiments, the interval between the fin bodies (31) of the adjacent fins (30) can be maintained.

—Feature (6) of Embodiments—

In the heat exchanger (10) of the present embodiments, the width direction of the fin (30) is along the width direction of the flat tube (20). The length of the tube receiving opening (33) in the width direction of the fin (30) is greater than half the width of the fin (30). The open end-side protruding tabs (40*a*) provided for the longer side edge portions (34) of the fin (30) are closer to the open end (36) of the tube receiving opening (33) than the center in the width direction of the fin (30).

In the heat exchanger (10) of the present embodiments, the shorter side edge portion (35) extending along the closed end (37) of the tube receiving opening (33) is located across the widthwise center of the fin (30) from the open end (36) of the tube receiving opening (33). Thus, the closed end-side protruding tab (40*b*) formed on the shorter side edge portion (35) is located opposite to the open end (36) of the tube receiving opening (33) with respect to the widthwise center of the fin (30). The open end-side protruding tabs (40*a*) provided for the longer side edge portions (34) are arranged closer to the open end (36) of the tube receiving opening (33) than the widthwise center of the fin (30).

In the heat exchanger (10) of the present embodiments, the protruding tabs (40*a*, 40*b*) are provided on both sides of the widthwise center of the fin (30) in the width direction of the fin (30). The protruding tabs (40*a*, 40*b*) make contact with the fin body (31) of the adjacent fin (30), thereby maintaining the interval between the fin bodies (31) of the adjacent fins (30). Therefore, according to the heat exchanger (10) of the present embodiments, the inclination of the fin bodies (31) in the width direction of the fins (30) can be reduced.

—Feature (7) of Embodiments—

In the heat exchanger (10) of the present embodiments, each of the open end-side protruding tabs (40*a*) provided for the longer side edge portions (34) has the side portion (43) which is close to the open end (36) of the tube receiving opening (33) and tilted toward the closed end of the tube receiving opening (33) as it extends from the base end to tip end of the open end-side protruding tab (40*a*).

In the fin (30) of the heat exchanger (10) of the present embodiments, the side portions (43) of the open end-side protruding tabs (40*a*) which are close to the open end (36) of the tube receiving opening (33) are tilted toward the closed end (37) of the tube receiving opening (33). Therefore, when the heat transfer tube (20) is inserted into the tube receiving opening (33) from the open end (36) toward the closed end (37), the heat transfer tube (20) is less likely to be caught by the side portions (43) of the open end-side protruding tabs (40*a*).

—Feature (8) of Embodiments—

The air conditioner (110) of the present embodiments includes the refrigerant circuit (120) provided with the heat exchanger (10) of the present embodiments, and circulates a refrigerant in the refrigerant circuit (120) to perform a refrigeration cycle. Thus, the air conditioner (110) including the heat exchanger (10) of the present embodiments is realized.

—Feature (9) of Embodiments—

As shown in FIG. 6, in the fin (30) of the heat exchanger (10) of the present embodiments, the tip end (42) of the open end-side protruding tab (40*a*) has a wavy shape meandering in the extending direction of the open end-side protruding tabs (40*a*). The tip end portions (41) of the pair of open end-side protruding tabs (40*a*) provided for the single collar (32) have complementary shapes.

If the tip end (42) of each of the open end-side protruding tabs (40*a*) extends linearly, the distance from the base end to tip end (42) of the open end-side protruding tab (40*a*) is equal to or less than ½ of the width of the tube receiving opening (33) (specifically, the interval between the pair of longer side edge portions (34) facing each other).

In contrast, in the fin (30) of the present embodiments, the tip end (42) of each open end-side protruding tab (40*a*) has a wavy shape. Thus, the distance from the base end to tip end (42) of the open end-side protruding tab (40*a*) can be made greater than ½ of the width of the tube receiving opening (33).

Therefore, according to the fin (30) of the present embodiments, a settable range of the height H1 of the open end-side protruding tab (40*a*) can be widened as compared with the case in which the tip end (42) of the open end-side protruding tab (40*a*) extends linearly. As a result, a settable range of the interval between the adjacent fins (30) can be widened, which can increase the degree of freedom in design of the heat exchanger (10).

Suppose that the height H1 of the open end-side protruding tabs (40*a*) is the same, a portion of the open end-side protruding tab (40*a*) of the fin (30) of the present embodiments bent outward of the tube receiving opening (33) can be made longer than that of the open end-side protruding tab (40*a*) having the tip end (42) extending linearly. As a result, a region of the tip end portion (41) of the open end-side protruding tab (40*a*) that makes contact with the adjacent fin (30) can be made longer, which can reliably maintain the interval between the adjacent fins (30).

First Variation of Embodiments

Figure 10:
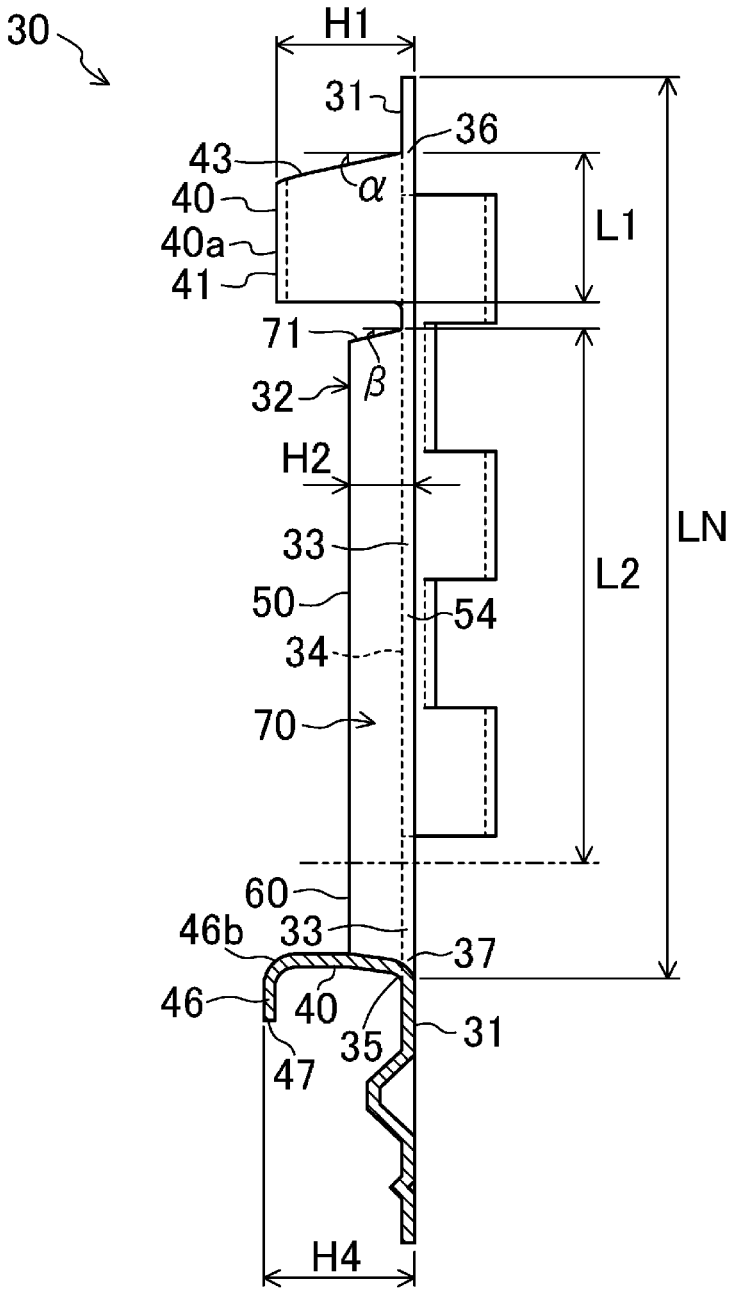
FIG. 10 is a cross-sectional view corresponding to FIG. 8, showing a cross section of a fin according to a first variation of the embodiments.

In the fins (30) of the heat exchanger (10) of the above embodiments, the tube joint portion (70) may be formed separately from the open end-side protruding tabs (40*a*) as shown in FIG. 10. Specifically, the collar (32) of the fin (30) may have the open end-side protruding tabs (40*a*) and the longer side joint portions (50) of the tube joint portion (70) separated from each other.

In the fins (30) of the present variation shown in FIG. 10, each of the longer side joint portions (50) of the tube joint portion (70) has a side portion (71) which is close to the open end (36) of the tube receiving opening (33) and is tilted toward the closed end (37) of the tube receiving opening (33). Specifically, the side portion (71) is tilted toward the closed end (37) of the tube receiving opening (33) as it extends from the base end to tip end of the longer side joint portion (50). In one or more embodiments, the side portion (71) has an inclination angle θ which is equal to or greater than 10° ($\beta \geq 10°$). The inclination angle θ of the side portion (71) is an angle of the side portion (71) with respect to a line perpendicular to the fin body (31).

Second Variation of Embodiments

Figure 11:
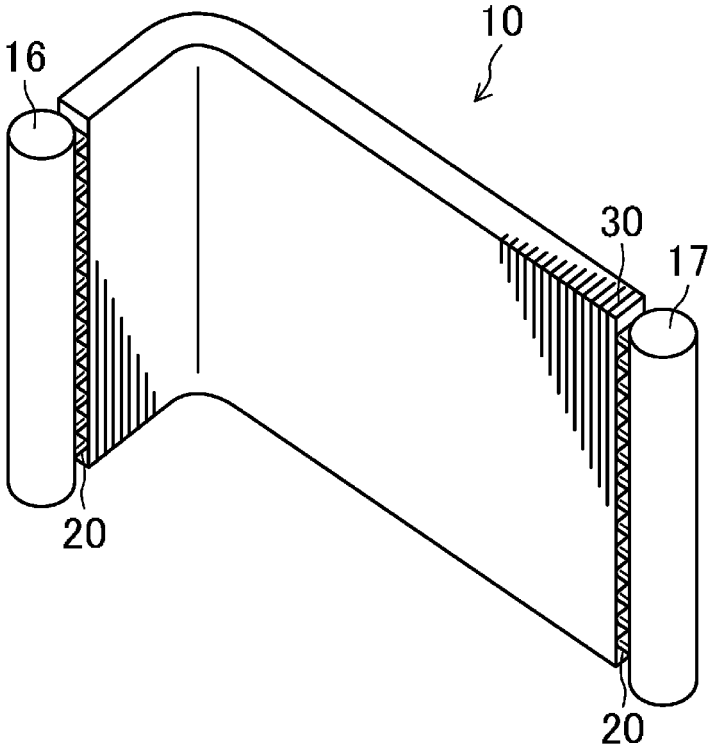
FIG. 11 is a schematic perspective view showing a heat exchanger according to a second variation of the embodiments.

As shown in FIG. 11, the heat exchanger (10) of the embodiments may be curved in the extending direction of the heat transfer tubes (20). The heat exchanger (10) shown in FIG. 11 is formed into an L-shape in plan view because the heat transfer tubes (20) are bent at a position in its extending direction. The heat exchanger (10) of each of the embodiments and variations thereof may have a shape in which the heat transfer tubes (20) are bent at two or more positions in the extending direction.

Third Variation of Embodiments

In the heat exchanger (10) of the embodiments and variations thereof, the fins (30) and the header collecting pipes (16, 17) may be fixed to the heat transfer tubes (20) using an adhesive as a joining material (i.e., fixed by adhesion). In this case, an adhesive having high thermal conductivity may be used as the adhesive.

Fourth Variation of Embodiments

The heat exchanger (10) of each of the embodiments and variations thereof may be coated with a hydrophilic resin or the like. The step of coating the heat exchanger (10) is performed after the joining step is finished (i.e., after the fins (30) and the header collecting pipes (16, 17) are brazed to the heat transfer tubes (20)).

Fifth Variation of Embodiments

In the fins (30) of the heat exchanger (10) of the embodiments, a plurality of closed end-side protruding tabs (40*b*) may be provided for each collar (32). The fins (30) of the present variation will be described with reference to FIGS. 12 to 14.

Figure 12:
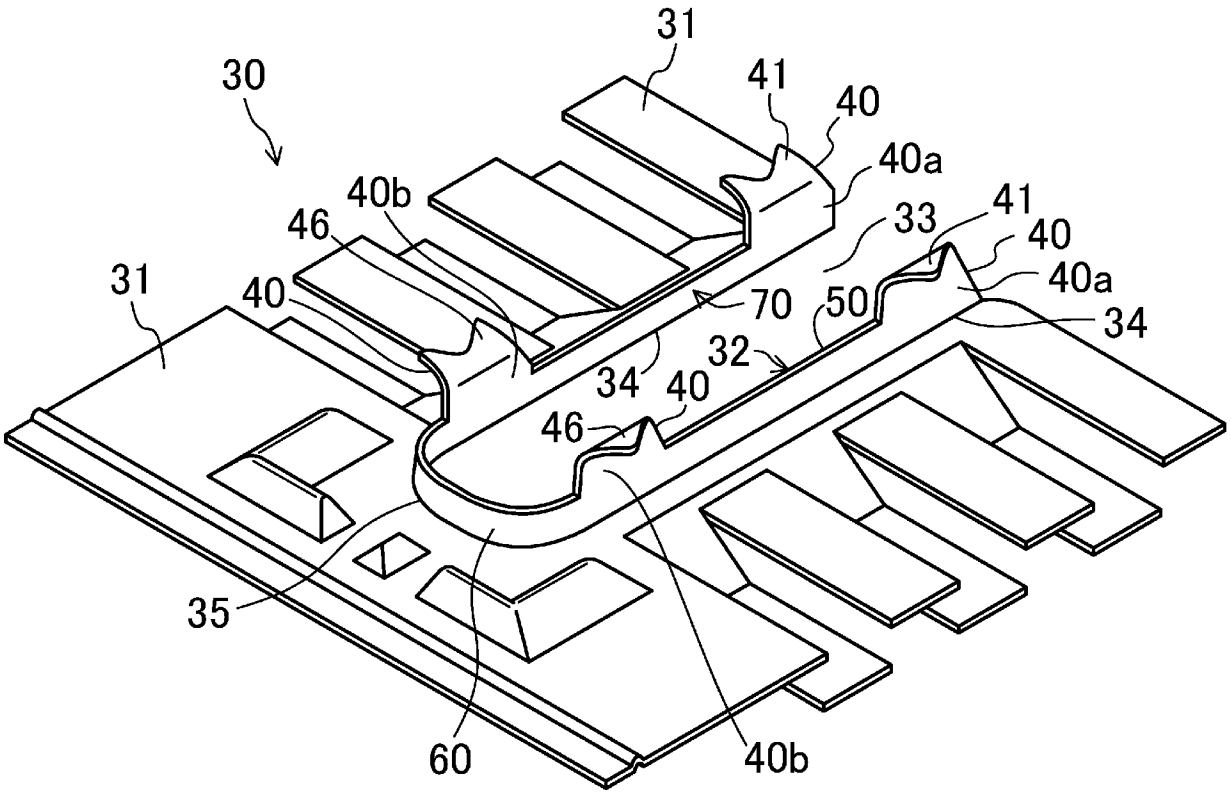
FIG. 12 is a perspective view showing a major part of a fin according to a fifth variation of the embodiments.
Figure 13:
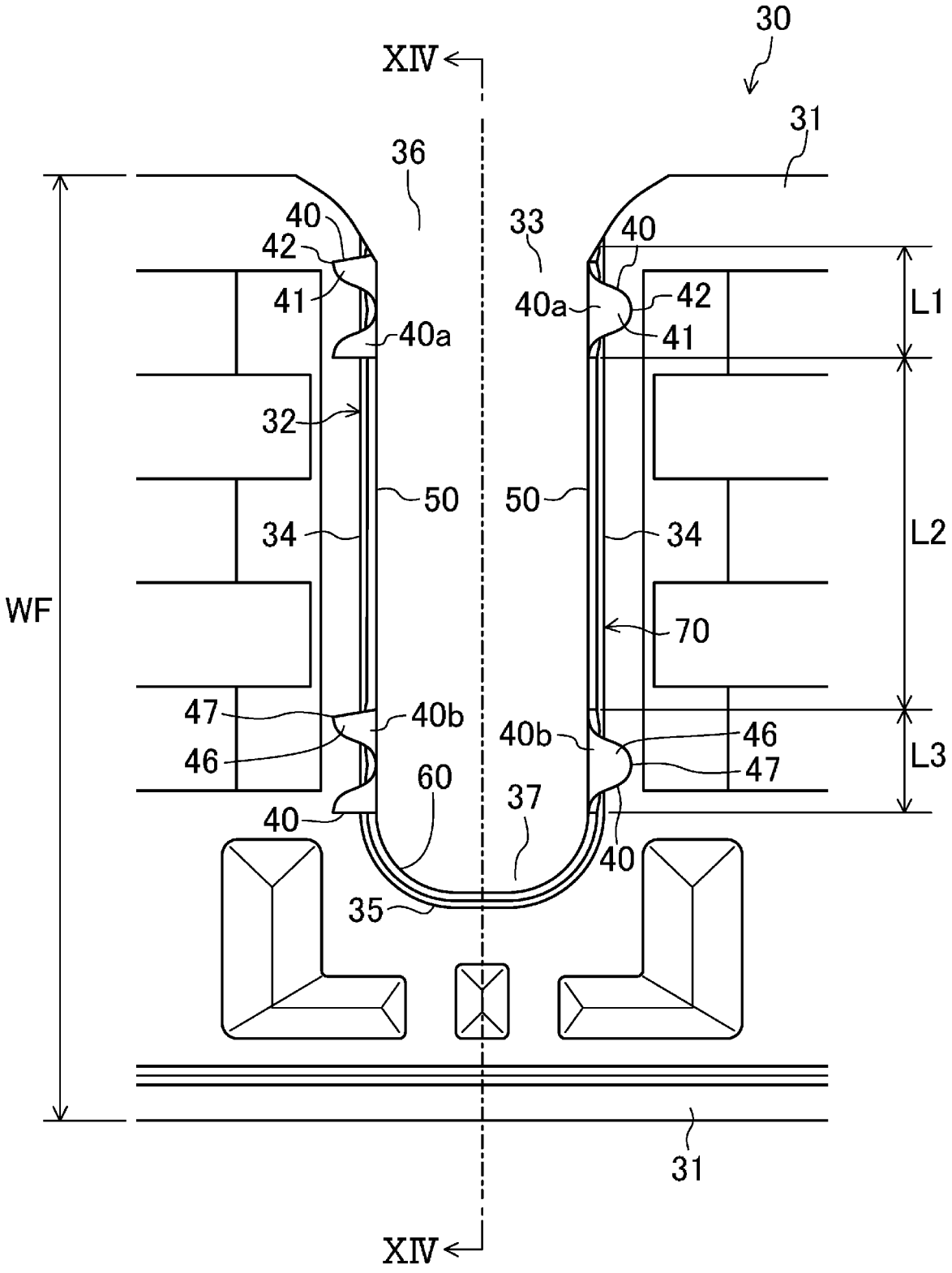
FIG. 13 is a plan view showing a major part of the fin according to the fifth variation of the embodiments.

The fin (30) of this variation shown in FIGS. 12 and 13 includes two closed end-side protruding tabs (40*b*) provided for each collar (32).

The closed end-side protruding tabs (40*b*) are plate-shaped portions each rising from the longer side edge portion (34). Each of the closed end-side protruding tabs (40*b*) is formed continuously from a portion of the longer side edge portion (34) including the closed end (37) of the tube receiving opening (33). That is, the closed end-side protruding tabs (40*b*) of the present variation are arranged near the closed end (37) of the tube receiving opening (33). In this variation, portions of the collar (32) of the fin (30) each extending along the longer side edge portions (34) of the tube receiving opening (33) and located between the open end-side protruding tabs (40*a*) and the closed end-side protruding tabs (40*b*) serve as the longer side joint portions (50).

Figure 14:
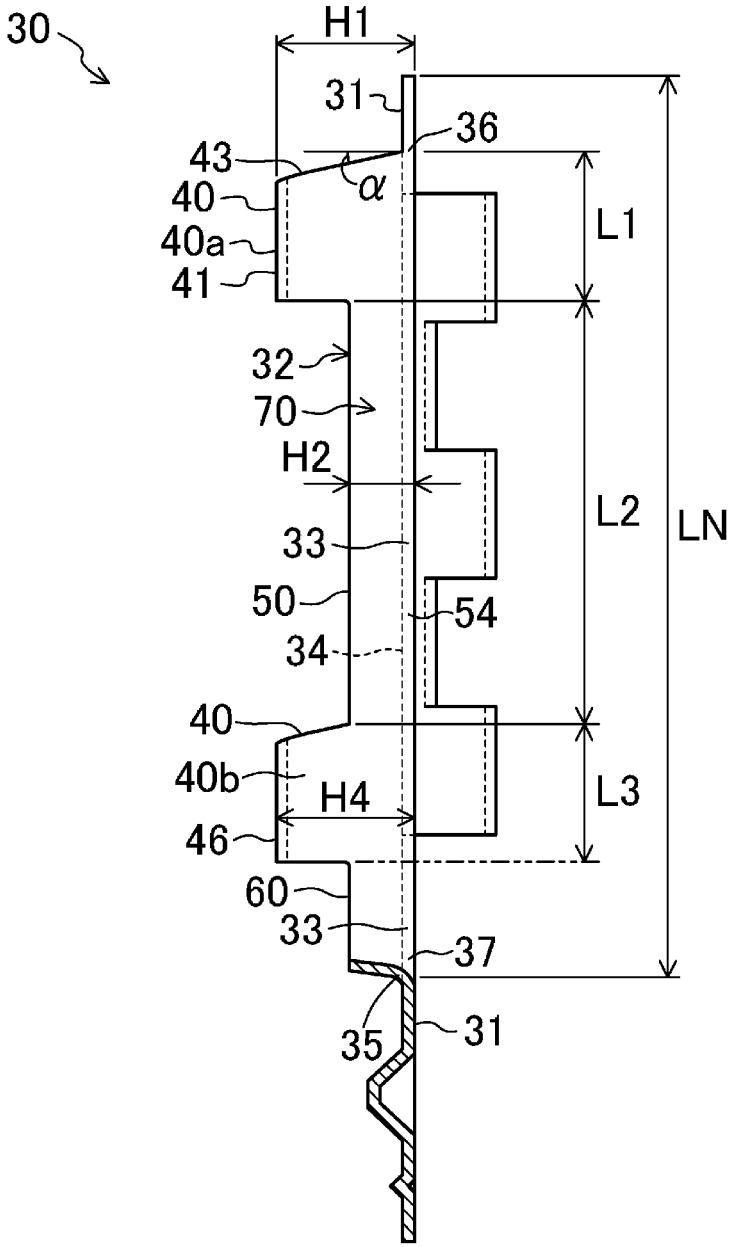
FIG. 14 is a cross-sectional view of the fin taken along line XIV-XIV of FIG. 13.

As shown in FIG. 13, the pair of closed end-side protruding tabs (40*b*) provided for the collar (32) face each other across the tube receiving opening (33). The closed end-side protruding tabs (40*b*) have a length L3 in the direction along the longer side edge portions (34). The length L3 of the closed end-side protruding tabs (40*b*) is smaller than the length L2 of the longer side joint portions (50). Therefore, in the fin (30) of the present variation, the length L1 of the open end-side protruding tabs (40*a*) and the length L3 of the closed end-side protruding tabs (40*b*) are smaller than the length L2 of the longer side joint portions (50) (L1<L2, L3<L2). Further, as shown in FIG. 14, also in the fin (30) of the present variation, the closed end-side protruding tabs (40*b*) have a height H4 equal to the height H1 of the open end-side protruding tabs (40*a*) (H4=H1).

As described above, the present disclosure is useful for a heat exchanger and an air conditioner.

Although the disclosure has been described with respect to only a limited number of embodiments, those skilled in the art, having benefit of this disclosure, will appreciate that various other embodiments may be devised without departing from the scope of the present disclosure.

REFERENCE SIGNS LIST

10 Heat Exchanger
20 Heat Transfer Tube (Flat Tube)
30 Fin
31 Fin Body
33 Tube Receiving Opening
34 Longer Side Edge Portion
36 Open End
37 Closed End
40 First Protruding tab
40*a* Open End-Side Protruding tab
40*b* Closed End-Side Protruding tab
50 Longer Side Joint Portion

What is claimed is:

1. A heat exchanger, comprising:
a flat tube having a width greater than a thickness of the flat tube; and
fins fixed to the flat tube and that each comprise a plate-shaped fin body, wherein
the plate-shaped fin body of each of the fins faces the plate-shaped fin body of an adjacent one of the fins,
each of the fins has a tube receiving opening into which the flat tube is inserted,
an edge of the tube receiving opening comprises a first longitudinal side edge portion extending in a width direction of the flat tube,
the tube receiving opening is in a notch shape that has:
an open end on a first side of the first longitudinal side edge portion; and
a closed end on a second side of the first longitudinal side edge portion,
each of the fins further comprises:
a first open end-side protruding tab that:
protrudes from the first longitudinal side edge portion toward a side of the plate-shaped fin body in a first direction intersecting with the plate-shaped fin body; and
comprises a tip end portion that contacts with the plate-shaped fin body of the adjacent one of the fins; and
a first longitudinal side joint portion protruding from the first longitudinal side edge portion toward the side of the plate-shaped fin body, wherein the first longitudinal side joint portion protrudes less in a direction orthogonal to the plate-shaped fin body than the first open end-side protruding tab protrudes in the direction,
the first longitudinal side joint portion contacts the flat tube inserted into the tube receiving opening, and
the first open end-side protruding tab is shorter than the first longitudinal side joint portion in a second direction along the first longitudinal side edge portion.

2. The heat exchanger according to claim 1, wherein the first open end-side protruding tab is disposed closer to the open end of the tube receiving opening than the first longitudinal side joint portion is.

3. The heat exchanger according to claim 2, wherein
the edge of the tube receiving opening further comprises
a second longitudinal side edge portion facing the first longitudinal side edge portion across the flat tube inserted into the tube receiving opening, and
each of the fins further comprises:
a second open end-side protruding tab that:
protrudes from the second longitudinal side edge portion toward the side of the plate-shaped fin body; and
comprises a tip end portion that contacts with the plate-shaped fin body of the adjacent one of the fins; and
a second longitudinal side joint portion protruding from the second longitudinal side edge portion toward the side of the plate-shaped fin body, wherein the second longitudinal side joint portion protrudes in the direction less than the second open end-side protruding tab protrudes in the direction.

4. The heat exchanger according to claim 3, wherein
the first open end-side protruding tab faces the second open end-side protruding tab, and
the first longitudinal side joint portion faces the second longitudinal side joint portion.

5. The heat exchanger according to claim 1, wherein
the edge of the tube receiving opening further comprises
a short side edge portion facing the closed end of the tube receiving opening, and
each of the fins further comprises a closed end-side protruding tab that:
protrudes from the short side edge portion toward the side of the plate-shaped fin body; and
comprises a tip end portion that contacts with the plate-shaped fin body of the adjacent one of the fins.

6. The heat exchanger according to claim 5, wherein
a width direction of the fins is along the width direction of the flat tube,
a length of the tube receiving opening in the width direction of the fins is greater than half a width of the fins, and
the first open end-side protruding tab is closer to the open end of the tube receiving opening than a center of the fins in the width direction of the fins is.

7. The heat exchanger according to claim 2, wherein the first open end-side protruding tab comprises an edge adjacent to the open end of the tube receiving opening and that is tilted toward the closed end of the tube receiving opening as the edge extends from a base to a tip of the first open end-side protruding tab.

8. An air conditioner, comprising:

a refrigerant circuit that comprises the heat exchanger according to claim 1, wherein the air conditioner circulates a refrigerant in the refrigerant circuit and performs a refrigeration cycle.

* * * * *